United States Patent [19]

Britz

[11] 4,393,529

[45] Jul. 19, 1983

[54] INVALID CHAIR

[76] Inventor: Elizabeth Britz, 2303 First Street, New Port Richey, Fla. 33552

[21] Appl. No.: 190,468

[22] Filed: Sep. 24, 1980

[51] Int. Cl.[3] ..... A61G 1/02; A61G 1/04; A61G 7/02

[52] U.S. Cl. ..... 5/81 R; 5/63; 5/82 R; 5/90; 297/440

[58] Field of Search ..... 5/81 B, 81 R, 82 R, 5/118, 90, 63; 297/440, 443

[56] References Cited

U.S. PATENT DOCUMENTS

| | | | |
|---|---|---|---|
| 3,110,912 | 11/1963 | Probst | 5/82 R |
| 3,167,789 | 2/1965 | Wicks | 5/81 R |
| 3,289,219 | 12/1966 | Fernrau et al. | 5/82 |
| 3,346,890 | 10/1967 | Thompson | 5/82 R |
| 3,377,078 | 4/1968 | Jackson | 5/82 R |
| 3,886,606 | 6/1975 | Bradford | 5/82 R |
| 3,918,109 | 11/1975 | Barraclougm | 5/82 R |
| 4,067,075 | 1/1978 | Lambers et al. | 5/82 R |

FOREIGN PATENT DOCUMENTS

| | | | |
|---|---|---|---|
| 1358413 | 3/1964 | France | 297/440 |
| 2586 | of 1915 | United Kingdom | 5/82 |

*Primary Examiner*—Alexander Grosz
*Attorney, Agent, or Firm*—Stanley M. Miller

[57] ABSTRACT

A two-part invalid chair is disclosed which enables a patient to be easily transferred from a lying position on a bed to a seated position on a chair, or vice versa. The first part of the chair consists of an elongated, tubular frame within which a body supporting web is suspended. The second part of the chair consist of troughs mounted to a support base, each having a semi-circular cross section which conforms to the shape of the tubular frame of the first part of the chair. This enables the frame to be readily mounted to or removed from the base portion. Both the tubular frame and the base portion are articulated at hinged joints to enable the patient, while seated in a chair, to assume a variety of body inclinations. The frame can be removed from the base with the patient seated therein and can be readily transferrred to a bed where the frame can unfold to a completely flat position enabling the easy transfer of the patient to the bed. Several embodiments are disclosed having features which complement the basic function of the invalid chair.

5 Claims, 24 Drawing Figures

FIG. 3
SEC. 3-3'
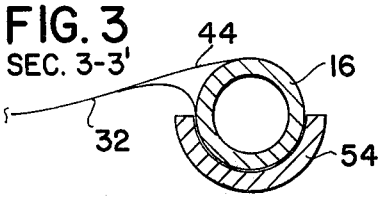
FIG. 4
SEC. 4-4'
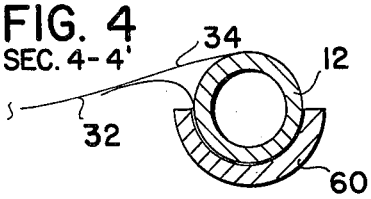
FIG. 5a
SEC. 5a-5a'
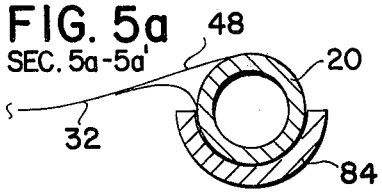
FIG. 5b
SEC. 5b-5b'
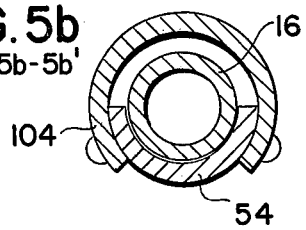
FIG. 1
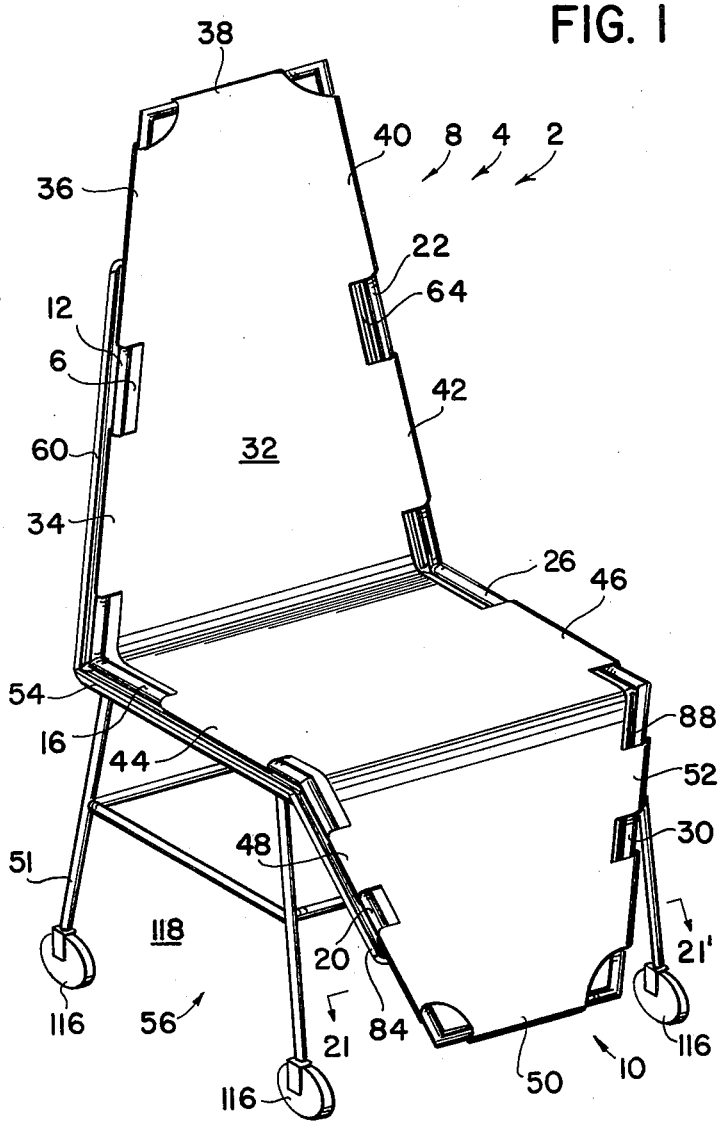
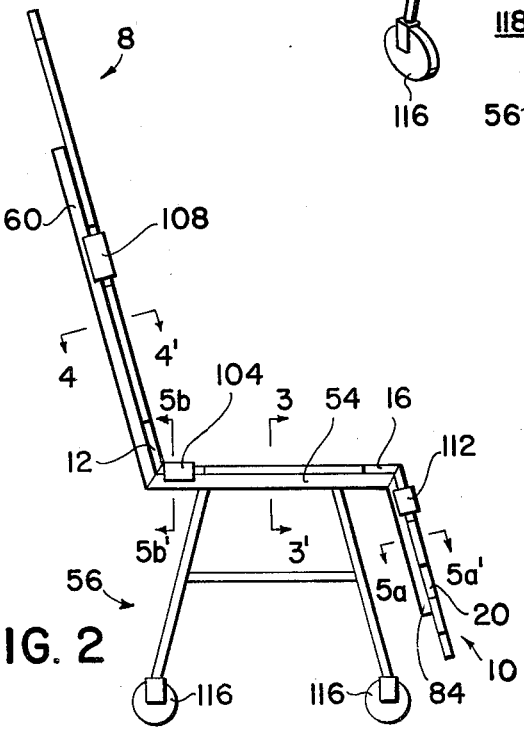
FIG. 2
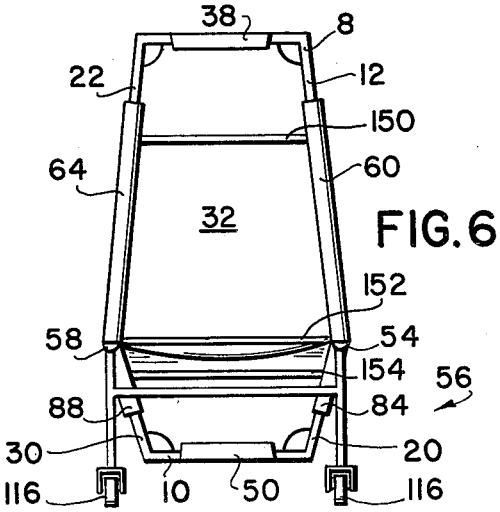
FIG. 6

FIG. 11
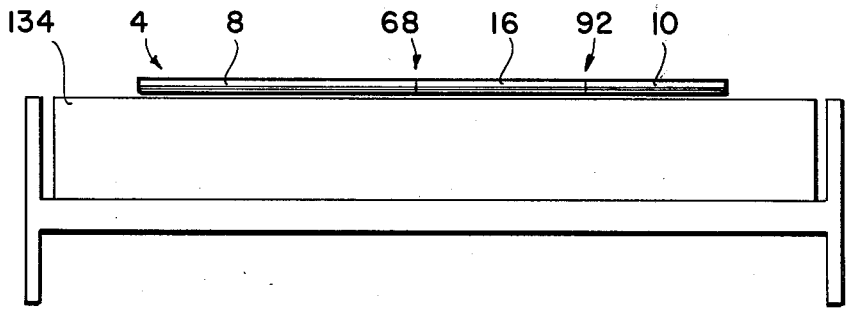
FIG. 10a
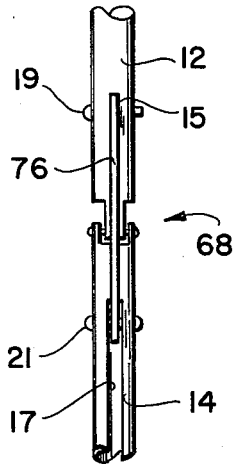
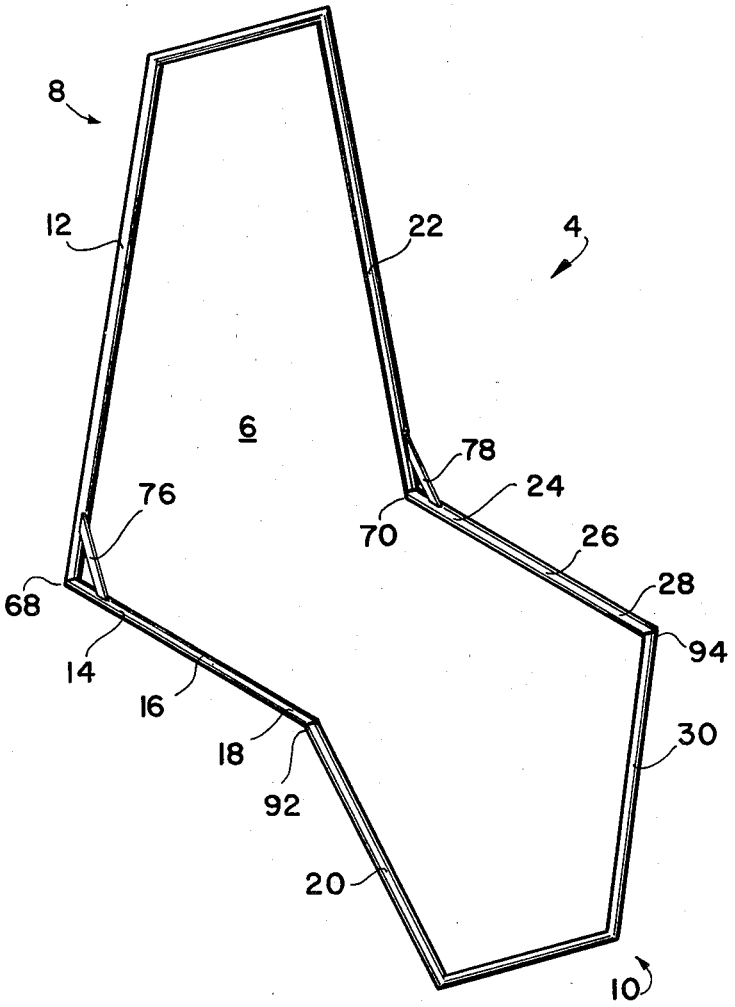
FIG. 7
FIG. 10b
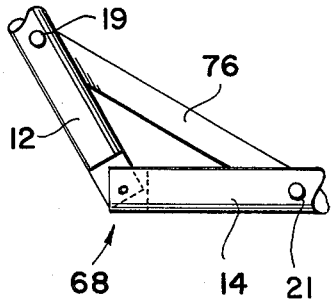

FIG. 8
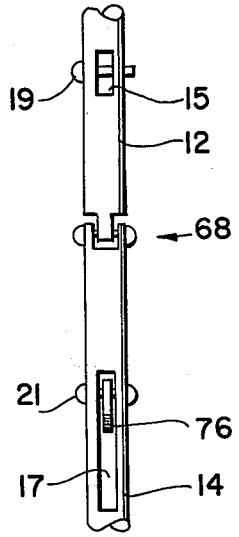
FIG. 9
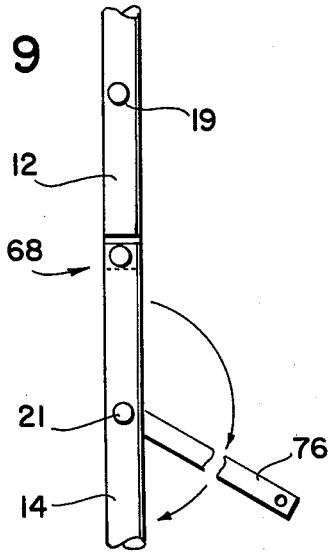
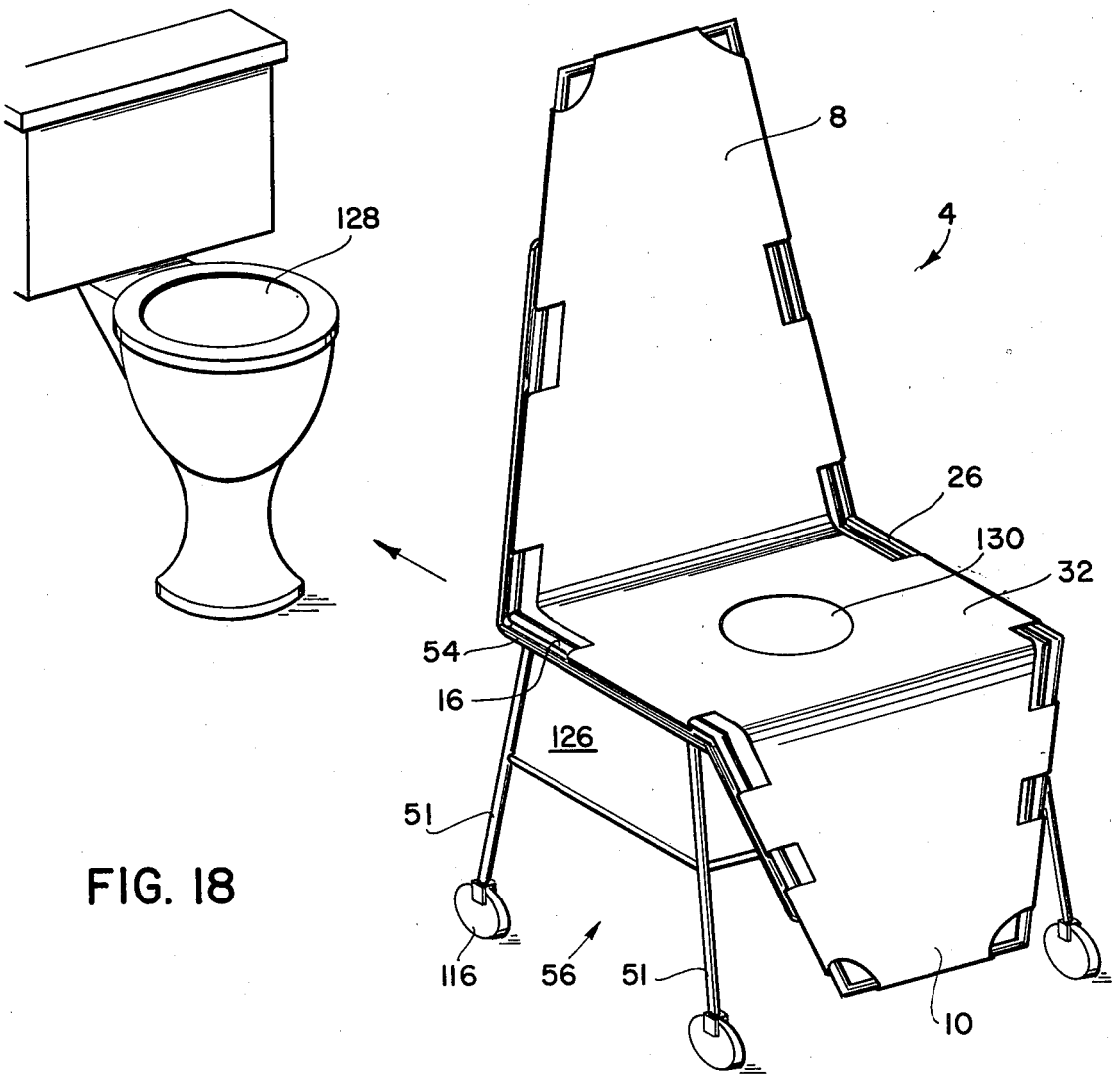
FIG. 18

SEC. 21-21'

FIG. 14
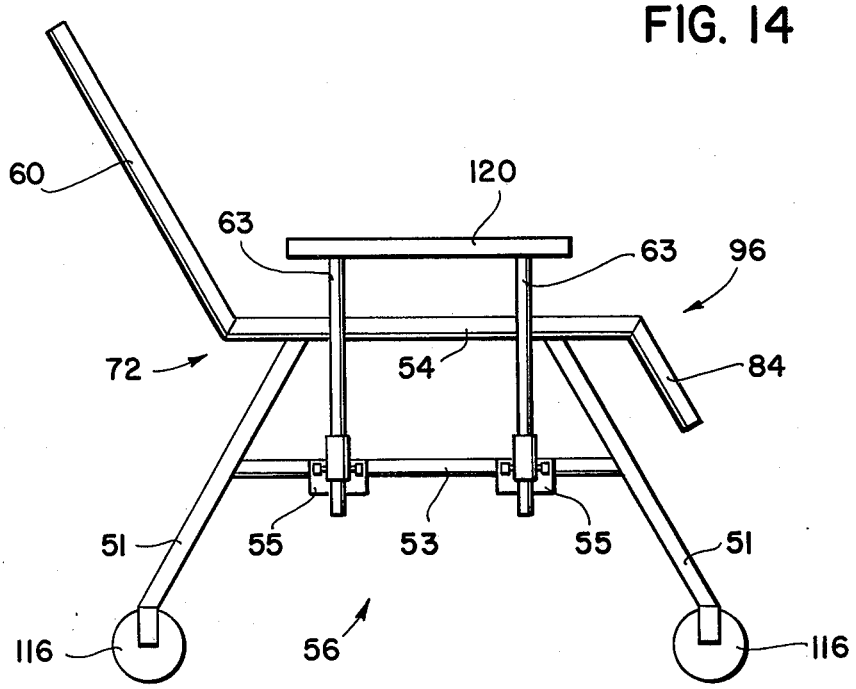
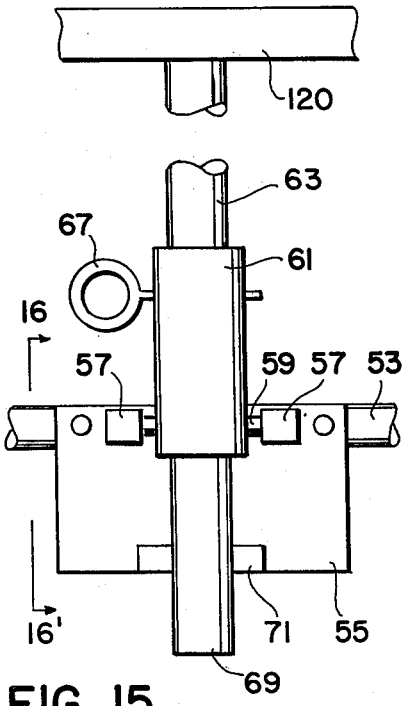
FIG. 15
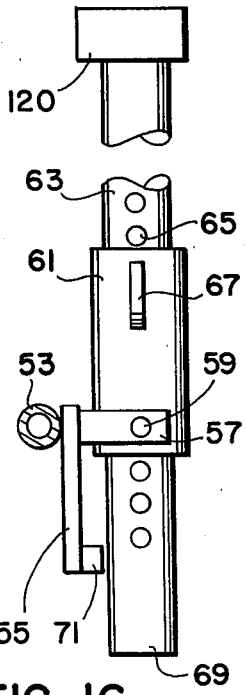
FIG. 16
SEC. 16-16'
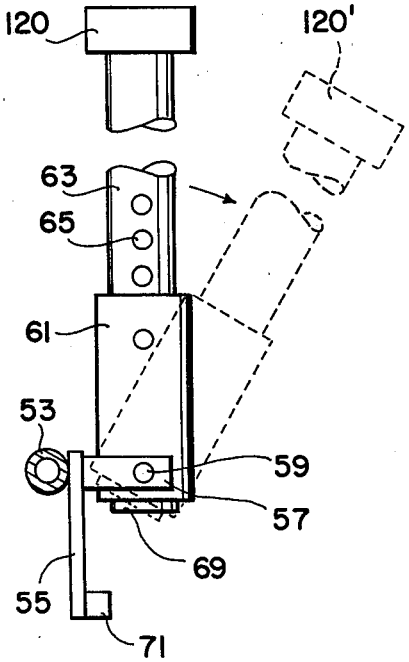
FIG. 17

INVALID CHAIR

FIELD OF THE INVENTION

The invention disclosed broadly relates to medical accessories and more particularly relates to improvements in hospital furniture.

BACKGROUND OF THE INVENTION

Invalids and other chronically ill persons who are bedridden require specialized care to prevent the formation of pressure sores or decubiti. Proper care for such patients includes providing good air flow around the patient and assisting the patient in moving from one position to another, where possible. Patients who are obese, severely arthritic, or who are recovering from recent surgery, have difficulty reorienting their bodies and find it nearly impossible to sit up. Since it is known that the action of moving the patient can prevent complications such as hypostatic pneumonia, large scale apparatus such as motorized hospital beds have been employed to introduce a certain artificial mobility to the body parts. What is needed, however, is a simpler technique to easily transfer the bedridden patient from the bed to a seated position. Even more beneficial would be a mechanism for easily transferring the bedridden patient from the bed to a wheelchair to enable a change of scene out of the hospital room.

OBJECTS OF THE INVENTION

It is therefore an object of the invention to provide an improved means for supporting a bedridden patient while articulating his body parts.

It is another object of the invention to provide an improved means to assist a bedridden patient to assume a seated position.

It is still a further object of the invention to provide an improved means to transfer a patient from his bed to a seated position in a chair.

It is still a further object of the invention to provide an improved means to transfer a patient from his bed to a mobile chair.

It is still a further object of the invention to provide an improved means to comfortably transfer a bedridden patient from his bed to a seated position at a toilet.

It is still a further object of the invention to provide an improved means to transfer a bedridden patient from a mobile chair back to his bed.

SUMMARY OF THE INVENTION

These and other objects, features, and advantages of the invention are achieved by the invalid chair disclosed herein. A two-part invalid chair is disclosed which enables a patient to be easily transferred from a lying position on a bed to a seated position on a chair, or vice versa. The first part of the chair consists of an elongated, tubular frame within which a body supporting web is suspended. The second part of the chair consists of troughs mounted to a support base, each having a semi-circular cross section which conforms to the shape of the tubular frame of the first part of the chair. This enables the frame to be readily mounted to or removed from the base portion. Both the tubular frame and the base portion are articulated at hinged joints to enable the patient, while seated in a chair, to assume a variety of body inclinations. The frame can be removed from the base with the patient seated therein and can be readily transferred to a bed where the frame can unfold to a completely flat position enabling the easy transfer of the patient to the bed. Several embodiments are disclosed having features which complement the basic function of the invalid chair.

Some of the subsidiary features of the invention which are disclosed herein include a modification to the invalid chair to enable the patient to be easily transferred to a toilet. Another feature of the invention is the provision of an elevator mechanism mounted on the base for selectively elevating the tubular frame with respect to the base, up to the level of the patient's bed, so as to enable the easy transfer of the patient. Another feature of the invalid chair is an adjustable armrest which swings out of the way of the tubular frame when it is mounted to or removed from the base.

DESCRIPTION OF THE FIGURES

These and other objects, features, and advantages of the invention will be more fully appreciated with reference to the accompanying figures.

FIG. 1 is an overall view of the invalid chair.

FIG. 2 is a side view of the invalid chair.

FIG. 3 is a cross sectional view along section line 3—3' of FIG. 2.

FIG. 4 is a cross sectional view along section line 4—4' of FIG. 2.

FIG. 5*a* is a cross sectional view along the section line 5*a*—5*a'* of FIG. 2.

FIG. 5*b* is a cross sectional view along the section line 5*b*—5*b'* of FIG. 2.

FIG. 6 is a back view of the invalid chair invention.

FIG. 7 is an overall view of the tubular frame.

FIG. 8 is a top view of the hinge 68 for the tubular frame.

FIG. 9 is a side view of the hinge 68 for the tubular frame.

FIG. 10*a* is another top view of the hinge 68 for the tubular frame, featuring the brace 76.

FIG. 10*b* is a side view of the brace 76.

FIG. 11 is a side view of the invalid chair frame lying flat on a bed.

FIG. 14 is a side view of the invalid chair showing the adjustable armrest 120.

FIG. 15 is a more detailed view of the support mechanism for the armrest 120.

FIG. 16 is a cross sectional view along the section line 16—16' of FIG. 15.

FIG. 17 is a cross sectional view which is a modification of FIG. 16, showing the adjustable armrest in its upwardly extended position, and includes a phantom illustration of the swing-away position 120' for the armrest.

FIG. 18 shows another embodiment of the invalid chair invention which is suitable for positioning over a toilet.

DISCUSSION OF THE PREFERRED EMBODIMENT

Figure 12:
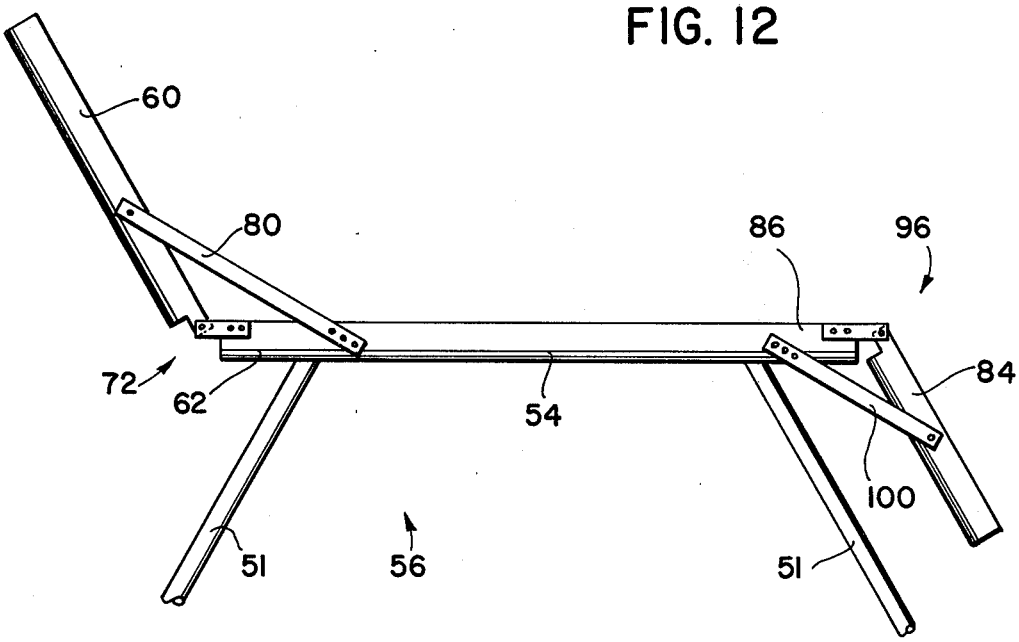
FIG. 12 is a side view of the base portion 56 with the hinged joints 72 and 96.

A two-part invalid chair is disclosed which enables a patient to be easily transferred from a lying position on a bed to a seated position on a chair, or vice versa. The first part of the chair consists of an elongated, tubular frame within which a body supporting web is suspended. The second part of the chair consists of troughs mounted to a support base, each having a semi-circular cross section which conforms to the shape of the tubular frame of the first part of the chair. This enables the frame to be readily mounted to or removed from the base portion. Both the tubular frame and the base portion are articulated at hinged joints to enable the patient, while seated in a chair, to assume a variety of body inclinations. The frame can be removed from the base with the patient seated therein and can be readily transferred to a bed where the frame can unfold to a completely flat position enabling the easy transfer of the patient to the bed. Several embodiments are disclosed having features which complement the basic function of the invalid chair.

An overall view of the two-part invalid chair 2 is shown in FIG. 1 and other views of the chair are shown in FIGS. 2, 6, 7, 14 and 19. The invalid chair 2 consists of a first part which is the elongated tubular frame 4 with the body supporting web 32 suspended therein and a second part consisting of the support base 56.

The elongated, tubular frame 4 has an open inner area 6 bounded by a U-shaped, tubular, head-supporting portion 8 on a first end and a U-shaped, tubular, foot-supporting portion 10 on a second end. A first leg 12 of the head portion 8 is connected to a first end 14 of a first tubular, flank-supporting portion 16 whose second end 18 is connected to a first leg 20 of the foot-supporting portion 10. A second leg 22 of the head portion 8 is connected to a first end 24 of a second, tubular, flank-supporting portion 26 whose second end 28 is connected to a second leg 30 of the foot-supporting portion 10.

The body supporting web 32 is suspended in the open inner area 6 of the frame 4 and is mounted to the U-shaped head-supporting portion 8 at the overlapped edges 34, 36, 38, 40 and 42. The body supporting web 32 is mounted to the flank-supporting portion 16 at the overlapped edge 44 and to the flank-supporting portion 26 at the overlapped edge 46. The body supporting web 32 is mounted to the U-shaped foot-supporting portion 10 at the overlapped edge 48, 50 and 52.

Figure 19:
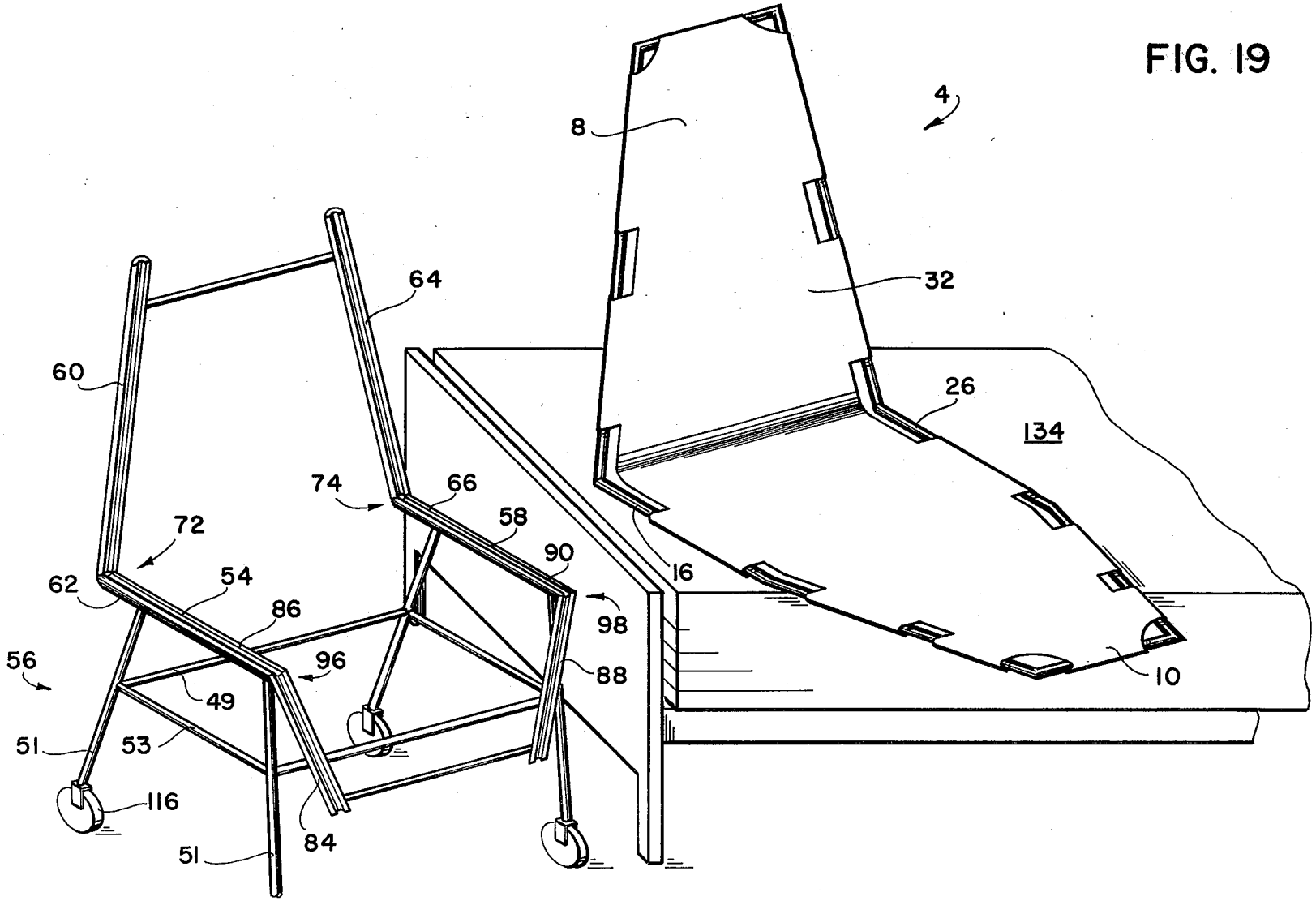
FIG. 19 is an overall view of the tubular frame 4 for the invalid chair at it is positioned on a bed in the upright position, ready to be transferred to the base 56.

The support base 56 includes a first horizontal trough 54 which is mounted to the support base. The first horizontal trough 54 has a semicircular cross section as shown in FIG. 3, which conforms to the shape of the first tubular, flank-supporting portion 16 of the frame 4. A second horizontal trough 58 shown in FIG. 19, is mounted to the support base 56, and has a semi-circular cross section which conforms to the shape of the second tubular, flank-supporting portion 26 of the frame 4. In this manner, the flank-supporting portions 16 and 26 can be removably mounted to the first and second horizontal troughs 54 and 58, respectively, of the support base 56.

As may be seen to better advantage in FIGS. 1, 7 and 19, the first flank-supporting portion 16 and the second flank-supporting portion 26 of the frame 4 are in a substantially, mutually parallel relationship at a predetermined separation distance. The first horizontal trough 54 and the second horizontal trough 58 are mounted to the support base 56 in a substantially, mutually parallel relationship at that predetermined separation distance, for removably mounting the respective flank-supporting portions 16 and 26 thereto.

As is seen in FIGS. 1, 2, 6 and 19, a first upper trough 60 is mounted to a first end 62 of the first horizontal trough 54. The first upper trough 60 has a semi-circular cross section shown in FIG. 4, which conforms to the shape of the first leg of the U-shaped, tubular, head-supporting portion 8 of the frame 4. A second upper trough 64 is mounted to the first end 66 of the second horizontal trough 58, and has a semi-circular cross section which conforms to the shape of the second leg 22 of the U-shaped, tubular, head-supporting portion 8 of the frame 4. In this manner, the head-supporting portion 8 can be removably mounted to the upper troughs 60 and 64.

The first upper trough 60 and the second upper trough 64 are mounted to the respective first horizontal trough 54 and second horizontal trough 58, in a mutually spaced relationship, for removably mounting the tubular contours of the respective first leg 12 and second leg 22 of the head-supporting portion 8 of the frame 4 into the semi-circular contours of the respective upper troughs 60 and 64.

As may be seen to better advantage in FIGS. 7, 8, 9, 10*a*, 10*b*, and 11, the first leg 12 of the U-shaped head-supporting portion 8 of the frame 4 is hingedly mounted by means of the hinge 68 to the first end 14 of the flank-supporting portion 16. The second leg 22 of the U-shaped head-supporting portion 8 of the frame 4 is hingedly mounted by means of the hinge 70 to the first end 24 of the second flank-supporting portion 26. In this manner, both supine and seated positions can be accommodated by the frame 4.

With reference to FIGS. 12 and 19, the first upper trough 60 of the base 56 is hingedly mounted by means of the hinge 72 to the first end 62 of the first horizontal trough 54. The second upper trough 64 of the base 56 is hingedly mounted by means of the hinge 74 to the first end 66 of the second horizontal trough 58. In this manner, both supine and seated positions can be accommodated by the frame 4 when mounted on the upper trough 60 and 64 of the base 56.

With respect to FIGS. 7, 8, 9, 10*a*, 10*b* and 19, a first brace 76 is connected between the first leg 12 of the head portion 8 and at a first end 14 of the first flank portion 16. A second brace 78 is connected between the second leg 22 of the head portion 8 and the first end 24 of the second flank portion 26. In this manner, a stable seated position can be accommodated by the frame 4. The braces 76 and 78 can be released from the respective legs 12 and 22 by pulling the pins 19. This will free the braces 76 and 78 from slots 15 so they can fold about their pivots 21 and out of the way into the slots 17 in the flank portions 16 and 26, respectively.

With reference to FIGS. 12 and 19, a first adjustable brace 80 at the hinge 72 is connected between the first upper trough 60 of the base 56 and the first end 62 of the first horizontal trough 54. A second adjustable brace at the hinge 74 is identical to the brace 80, and is connected between the second upper trough 64 of the base 56 and the first end 66 of the second horizontal trough 58. In this manner, an adjustable inclination to the head portion 8 of the frame 4 can be achieved when mounted in the upper troughs 60 and 64 of the base 56.

As is shown in FIG. 5*a* and FIG. 19, a first lower trough 84 is mounted to a second end 86 of the first horizontal trough 54, and has a semi-circular cross section which conforms to the shape of the first leg 20 of the U-shaped, tubular, foot-supporting portion 10 of the frame 4. A second lower trough 88 is mounted to a second end 90 of the second horizontal trough 58, having a semi-circular cross section which conforms to the shape of the second leg 30 of the U-shaped, tubular, foot-supporting portion 10 of the frame 4. This enables the foot-supporting portion 10 to be removably mounted to the lower trough 84 and 88.

With reference to FIG. 5*a*, the first lower trough 84 and the second lower trough 88 are mounted to the respective first horizontal trough 54 and second horizontal trough 58 in a mutually spaced relationship, for removably mounting the tubular contours of the respective first leg 20 and second leg 30 of the foot-supporting portion 10 of the frame 4 into the semi-circular contours of the respective lower troughs 84 and 88.

As is shown in FIGS. 2, 7, 8, 9 and 11, the first leg 20 of the U-shaped foot-supporting portion 10 of the frame 4 is hingedly mounted by means of the hinge 92 to the second end 18 of the first flank-supporting portion 16. The second leg 30 of the U-shaped foot-supporting portion 10 of the frame 4 is hingedly mounted by means of the hinge 94 to the second end 28 of the second flank-supporting portion 26. In this manner, the relative elevation of a patient's feet can be adjusted by the frame 4.

Figure 13:
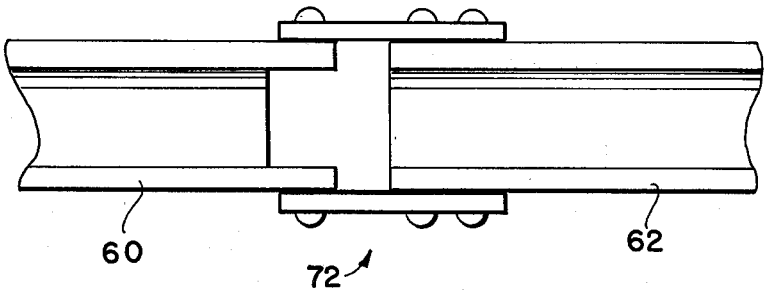
FIG. 13 is a top view of the hinged joint 72.

With reference to FIGS. 12, 13 and 19, the first lower trough 84 of the base 56 is hingedly mounted by means of the hinge 96 to the second end 86 of the first horizontal trough 54. The second lower trough 88 of the base 56 is hingedly mounted by means of the hinge 98 to the second end 90 of the second horizontal trough 58. This enables the relative elevation of a patient's feet to be adjusted by the frame 4 when it is mounted on the lower troughs 84 and 88 of the base 56.

With reference to FIGS. 12 and 19, a first adjustable brace 100 at the hinge 96 is connected between the first lower trough 84 of the base 56 and the second end 86 of the first horizontal trough 54. A second adjustable brace at hinge 98 is identical to the brace 100, and is connected between a second lower trough 88 of the base 56 and a second end 90 of the second horizontal trough 58. This enables an adjustable inclination of the foot portion 19 of the frame 4 when it is mounted to the lower trough 84 and 88 of the base 56.

As shown in FIGS. 2 and 5*b*, a first clamp 104 is mounted to the first horizontal trough 54 of the base 56, for clamping the first flank-supporting portion 16 of the frame 4 thereto. A second clamp identical to clamp 104, is mounted to the second horizontal trough 58 of the base 56, for clamping the second flank-supporting portion 26 of the frame 4 thereto.

For the head-supporting portion 8, a first clamp 108 is mounted to the first upper trough 60 of the base 56, for clamping the first leg 12 of the head-supporting portion 8 of the frame 4 thereto. A second clamp identical to clamp 108, is mounted to the second upper trough 64 of the base 56, for clamping the second leg 22 of the head-supporting portion 8 of the frame 4 thereto.

With respect to the foot-supporting portion 10, a first clamp 112 is mounted to the first lower trough 84 of the base 56, for clamping the first leg 20 of the foot-supporting portion 10 of the frame 4 thereto. A second clamp identical to clamp 112, is mounted to the second lower trough 88 of the base 56, for clamping the second leg 30 of the foot-supporting portion 10 of the frame 4 thereto.

As is seen in FIGS. 1 and 19, wheels 116 are mounted on the bottom of the support base 56, for supporting the base 56 on the floor 118. This enables the invalid chair to have a greater mobility.

FIGS. 14, 15, 16, 17 and 19 show a first adjustable armrest 120 which is mounted to the support base 56 in a position proximate to the first horizontal trough 54. A second adjustable armrest identical to armrest 120, is mounted to the support base 56 in a position proximate to the second horizontal trough 58. In this manner, the first armrest 120 and second armrest can be positioned out of the vicinity of the flank portions 16 and 26 of the frame 4 when they are to be attached to or removed from the horizontal troughs 54 and 58 of the base 56. The base 56 includes the chair legs 51 which are joined by the cross member 53. Two vertical plates 55 are rigidly mounted to the cross member 53 and support the pivot blocks 57. On each plate 55, the pivot projections 59 from the pivoting sleeve 61 are mounted in the pivot blocks 57. The sleeve 61 supports the armrest shaft 63 which vertically slides in the sleeve 61. Holes 65 through the shaft 63 enable the adjustment pin 67 to pass through the sleeve 61 and the selected adjustment hole 65 to lock the vertical position for the armrest 120, as desired. When the bottom end 69 of the shaft 63 is below the abutment block 71, the shaft 63 is maintained in a vertical position and various vertical adjustments to the armrest 120 can be made. When the lower end 69 of the shaft 63 is brought above abutment block 71 by raising the armrest 120 to its highest position, as shown in FIG. 17, then the abutment block 71 no longer blocks the pivoting motion of the sleeve 61. Thus, the armrest 120 can be moved laterally out of the way into the phantom position 120' shown in FIG. 17, when it is desired to either mount or remove the frame 4 from the base 56.

Figure 21:
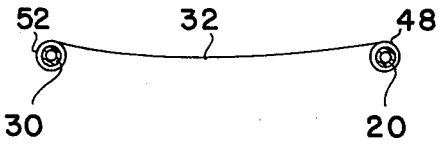
FIG. 21 is a cross sectional view along the section line 21—21' of FIG. 1, showing a first embodiment for the body supporting web 32.

FIG. 21 shows one embodiment of the body-supporting web 32 as a frabric web suspended in the open inner area 6 from the frame 4. Optionally, a Foley carrier feature can be included in the web 32 to enable better drainage of a Foley catheter and easier handling in a concealed position.

Figure 22:
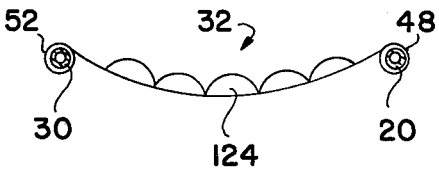
FIG. 22 is a cross sectional view similar to that shown in FIG. 21, illustrating a second embodiment for the body supporting web 32.

FIG. 22 shows another embodiment of the body-supporting web 32 as an air inflatable web 124 suspended in the open inner area 6 from the frame 4. A safety belt can be added, if desired.

FIG. 18 shows another embodiment of the invention where the support base 56 has an opening 126 on its rearward side where the cross-brace 49 of FIG. 19 has been removed, for selectively positioning the flank-supporting portions 16 and 26 of the frame 4 over a toilet bowl 128. The body-supporting web 32 has an aperture 130 therethrough between the first flank-supporting portion 16 and the second flank-supporting portion 26. In this manner, the aperture 130 can be selectively juxtaposed over the toilet bowl 128.

Figure 20:
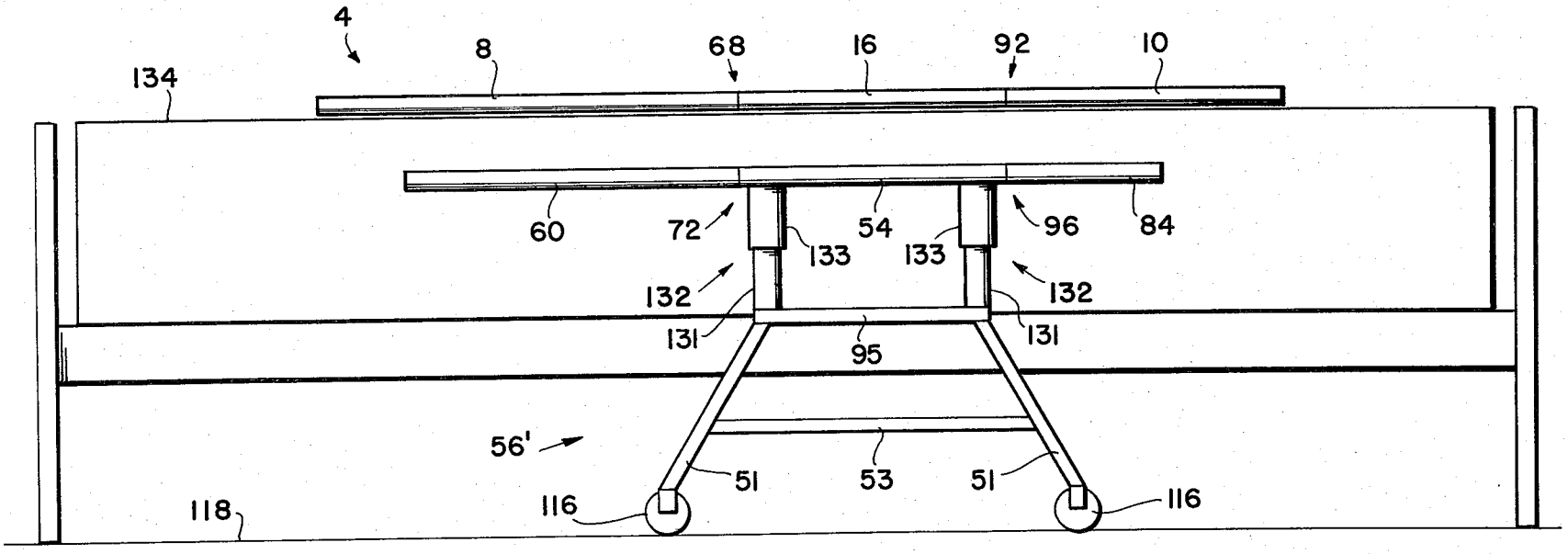
FIG. 20 illustrates another embodiment of the invention which features an elevator mechanism 132 for selectively elevating the tubular frame 4 with respect to the base 56' of the chair.

FIG. 20 shows still another embodiment of the invention which includes the elevator mechanism 132 which may be a screw-jack lift or a hydraulic lift with the lower stationary portion 131 mounted on the platform 95 of the support base 56 and the upper moving portion 133 supporting the first horizontal trough 54 and the second horizontal trough 58, for selectively elevating the frame 4 with respect to the base 56'. In this manner, the height of the horizontal troughs 54 and 58 can be adjusted to equal the height of a bed 134 to enable the frame 4 to be laterally displaced from the base 56' to the bed 134 or from the bed 134 to the base 56'.

As is seen in FIG. 6, the support base 56, or the modified support base 56' in FIG. 20, has a first cross brace 150 connected between the first upper trough 60 and the second upper trough 64, and a second cross brace 152 connected between the first horizontal trough 54 and the second horizontal trough 58, and a third cross brace 154 connected between the first lower trough 84 and the second lower trough 88. When the tubular frame 4 is lying in its flat, horizontal position on top of the support base 56' and is raised up to the level of the bed 134 as is shown in FIG. 20, the cross braces 150, 152, 154 can serve as tracks over which the tubular frame 4 can laterally slide to transfer the frame 4 from the support base 56' to the bed 134.

Although specific embodiments of the invention have been disclosed, it will be understood by those with skill in the art that minor changes can be made in the structural details of these embodiments without departing from the spirit and the scope of the invention.

What is claimed is:

1. A two-part invalid chair, comprising:

an elongated, tubular frame having an open inner area bounded by a U-shaped, tubular, head-supporting portion on a first end and a U-shaped, tubular, foot-supporting portion on a second end with a first leg of said head portion connected to a first end of a first tubular, flank-supporting portion whose second end is connected to a first leg of said foot-supporting portion and with a second leg of said head portion connected to a first end of a second, tubular, flank-supporting portion whose second end is connected to a second leg of said foot-supporting portion;

a body supporting web suspended in said open inner area of said frame and mounted to said U-shaped head-supporting portion, said flank-supporting portions and said U-shaped foot-supporting portion;

a first horizontal trough mounted to a support base, having a semi-circular cross section which conforms to the shape of said first tubular, flank-supporting portion of said frame and a second horizontal trough mounted to said support base, having a semi-circular cross section which conforms to the shape of said second tubular, flank-supporting portion of said frame, for removably mounting said flank-supporting portions to said support base;

said first and second flank-supporting portions of said frame being in a substantially, mutually parallel relationship at a predetermined separation distance;

said first and second horizontal troughs being mounted to said support base in a substantially, mutually parallel relationship at said predetermined separation distance for removably mounting said respective flank-supporting portions thereto;

a first clamp mounted to said first horizontal trough of said base, for clamping said first flank-supporting portion of said frame thereto;

a second clamp mounted to said second horizontal trough of said base, for clamping said second flank-supporting portion of said frame thereto;

a first upper trough mounted to a first end of said first horizontal trough, having a semi-circular cross section which conforms to the shape of said first leg of said U-shaped, tubular, head-supporting portion of said frame and a second upper trough mounted to a first end of said second horizontal trough, having a semi-circular cross section which conforms to the shape of said second leg of said U-shaped, tubular, head-supporting portion of said frame, for removably mounting said head-supporting portion thereto;

said first and second upper troughs being mounted to said respective first and second horizontal troughs in a mutually spaced relationship for removably mounting the tubular contours of said respective first and second legs of said head-supporting portion of said frame into said semi-circular contours of said respective upper troughs;

a first clamp mounted to said first upper trough of said base, for clamping said first leg of said head-supporting portion of said frame thereto;

a second clamp mounted to said second upper trough of said base, for clamping said second leg of said head-supporting portion of said frame thereto;

said first leg of said U-shaped head-supporting portion of said frame being hingedly mounted to said first end of said first flank-supporting portion and said second leg of said U-shaped head-supporting portion of said frame being hingedly mounted to said first end of said second flank-supporting portion;

said first upper trough of said base being hingedly mounted to said first end of said first horizontal trough and said second upper trough of said base being hingedly mounted to said first end of said second horizontal trough;

a first lower trough mounted to a second end of said first horizontal trough, having a semi-circular cross section which conforms to the shape of said first leg of said U-shaped, tubular, foot-supporting portion of said frame and a second lower trough mounted to a second end of said second horizontal trough, having a semi-circular cross section which conforms to the shape of said second leg of said U-shaped, tubular, foot-supporting portion of said frame, for removably mounting said foot-supporting portion thereto;

said first and second lower troughs being mounted to said respective first and second horizontal troughs in a mutually spaced relationship for removably mounting the tubular contours of said respective first and second legs of said foot-supporting portion of said frame into said semi-circular contours of said respective lower troughs;

a first clamp mounted to said first lower trough of said base, for clamping said first leg of said foot-supporting portion of said frame thereto; and a second clamp mounted to said second lower trough of said base, for clamping said second leg of said foot-supporting portion of said frame thereto.

2. The apparatus of claim 1, which further comprises:

a first adjustable armrest mounted to said support base proximate to said first horizontal trough;

a second adjustable armrest mounted to said support base proximate to said second horizontal trough;

whereby said first and second armrests can be positioned out of the vicinity of said frame when it is to be attached to or removed from said base.

3. The apparatus of claim 1, which further comprises:

said support base having an opening on its rearward side, for selectively positioning said flank-supporting portions of said frame over a toilet bowl;

said body-supporting web having an apperture therethrough between said first and second flank-supporting portions;

whereby said aperture can be selectively juxtaposed over said toilet bowl.

4. The apparatus of claim 1, which further comprises:

elevator means mounted on said support base and supporting said first and second horizontal troughs, for selectively elevating said frame with respect to said base;

whereby the height of said frame can be adjusted to equal the height of a bed to enable said frame to be laterally displaced from said base to said bed or from said bed to said base.

5. The apparatus of claim 4, which further comprises:

a cross brace mounted between said first and second horizontal troughs, forming a track over which said tubular frame can laterally slide to transfer said frame from said support base to said bed.

* * * * *